United States Patent [19]

Williams

[11] Patent Number: 4,781,467

[45] Date of Patent: Nov. 1, 1988

[54] FOAM-GENERATING APPARATUS

[75] Inventor: Leslie P. Williams, Port Neches, Tex.

[73] Assignee: CCA, Inc., Port Neches, Tex.

[21] Appl. No.: 108,464

[22] Filed: Oct. 15, 1987

Related U.S. Application Data

[63] Continuation-in-part of Ser. No. 849,690, Apr. 9, 1986, Pat. No. 4,705,405.

[51] Int. Cl.[4] ..... B01F 15/04

[52] U.S. Cl. ..... 366/150; 137/599.1; 137/889; 366/160; 366/163

[58] Field of Search ..... 366/150, 160, 163, 162, 366/177, 348, 349, 165, 167, 161; 137/889, 890, 599.1

[56] References Cited

U.S. PATENT DOCUMENTS

| | | | |
|---|---|---|---|
| 3,257,180 | 6/1966 | King | 137/599.1 |
| 3,782,695 | 1/1974 | Sandiford | 366/163 |
| 4,046,358 | 9/1977 | Grimes | 366/163 |
| 4,123,800 | 10/1978 | Mazzei | 366/150 |
| 4,430,001 | 2/1984 | Schurr | 366/163 |
| 4,475,821 | 10/1984 | Koch | 366/160 |
| 4,673,006 | 6/1987 | Speck | 366/150 |

*Primary Examiner*—Robert W. Jenkins

*Attorney, Agent, or Firm*—Pravel, Gambrell, Hewitt, Kimball & Krieger

[57] ABSTRACT

The invention involves a mixing apparatus capable of mixing two or more chemicals using a motive liquid. An ejector draws in a first chemical which is directed to the input of an eductor. A second chemical is connected directly to the eductor. The motive liquid provides the motive force for both the ejector and the eductor. By reason of the feeding of the first chemical to the eductor from the separate ejector rather than directly into the eductor, the ratio of the first chemical to the second chemical fed into the eductor is more accurately controlled than if both chemicals were directly fed to the eductor. The chemicals are mixed in the eductor and are discharged as a foam preferably through a foam nozzle.

8 Claims, 1 Drawing Sheet

FOAM-GENERATING APPARATUS

This is a continuation-in-part of Ser. No. 849,690 filed Apr. 9, 1986, now U.S. Pat. No. 4,705,405.

FIELD OF THE INVENTION

This invention relates to foam-generating devices.

BACKGROUND OF THE INVENTION

Pollution from industrial waste has been a chronic problem for chemical manufacturers, processors and refiners. It is not uncommon that during routine plant operations, equipment malfunctions, pipelines break or the process is otherwise upset causing a chemical spill. Only in the recent past has greater attention been focused on the need to quickly and efficiently contain chemical spills to prevent them from absorption into the earth with the attendant pollution problems of the adjacent aquifers which provide drinking water to nearby communities. Spills have brought other hazards mainly from the toxicity standpoint as a result of wind driven vapors adversely affecting the health of residents adjacent chemical manufacturing facilities and toxic waste sites.

As more attention was paid to the need to control spills and toxic waste and limit the impact of such spills on the surrounding communities, techniques were developed to physically contain the spilled material as well as to control poisonous or noxious vapors or odors emitted from the spilled material.

Prior techniques have involved physical containment using earthen barricades or dams. Processing units and storage facilities have been built atop concrete (coated and uncoated) mats so that spills can be channeled to a central location for treatment.

A frequent problem that occurs in sizeable spills is control of vapors or odors from the spilled material. In the past, various foams have been sprayed on the spilled material to minimize the odor and vapor problem. However, these foams broke down after a short time and had to be constantly reapplied to minimize the odor and vapor problem. Since the foam did not last very long, personnel and equipment had to be tied up adjacent the spill site, frequently for days, so that foam could constantly be reapplied as it broke down.

The need to have a stable, longlasting foam as a method of containing vapors and noxious odors is one of the problems addressed by the apparatus of the present invention. It has been determined that a foam can be chemically treated, with a stabilizing compound, so that after it is applied, the foam retains its body and turns into a gel-like substance. The gel-like substance, or stabilized foam, continues to cover the spilled material thereby effectively controlling vapors and odors for periods of time measured in days rather than minutes. In a recent experiment, stabilized foam created by the apparatus of the present invention effectively covered an approximate three acre site for approximately ninety days.

Stabilized form has another application in bomb disposal application. In the past, bomb squads have attempted to minimize the impact of a bomb, in the event it were to go off, by draping heavy mats over the bomb. This procedure has innate hazards in that the mere setting of the mats could detonate the bomb. Additionally, if a bomb is covered by other objects, such objects may have to be lifted off of the bomb before mats can be set down. Movement of objects off the bomb is another dangerous procedure which could set off the bomb. Other methods have involved spraying liquid nitrogen on the bomb so as to freeze the electrical components in the bomb thereby disarming it. However, this procedure involves transport of cumbersome equipment and handling of extremely cold liquids which can injure personnel if they come in contact with any part of the body. It was thus desirable to provide a method of encasing a bomb so as to limit the damage should the bomb go off. Using the apparatus of the present invention, stabilized foam can be quickly applied to the bomb, thereby encasing it and reducing, if not eliminating, the impact on explosion of the bomb. In one recently conducted experiment, one-sixteenth of a pound of C-4 explosive material was placed in a 3′ by 3′ cardboard box and the box was filled with stabilized foam. When the bomb was detonated, there was no subsequent damage to the box.

The stabilized foam is created by mixing a foam concentrate such as is presently available from the Minnesota Mining and Manufacturing Company under the name AFFF/ATC (FC 600). The stabilizer is also currently available from Minnesota Mining and Manufacturing Company under the description of FS-7000. Combinations of these two chemicals yield a stabilized foam which has been found to be beneficial in odor and vapor containment as well as an effective method in reducing or eliminating the impact from bombs frequently encountered by civilian bomb squads.

U.S. Pat. No. 4,475,821 relates generally to the field of mixing chemicals.

SUMMARY OF THE INVENTION

The invention discloses a mixing apparatus capable of mixing two or more chemicals. A motive liquid is connected to the apparatus which provides the motive power for an ejector which draws in a first chemical. The output of the first ejector is directed to the input of an ejector mixer. A second chemical is connected directly to the ejector mixer. The motive fluid provides the motive force for the ejector mixer. Thus, the two chemicals are independently fed and the flow rate of each is regulated with minimal effect from changes in the viscosities of either chemical. The ratios of the two chemicals can therefore be more closely controlled as compared to injecting both chemicals directly into the ejector mixer. The chemicals are thoroughly mixed in the ejector mixer and discharged from the apparatus. A foam nozzle can be mounted to the outlet of the apparatus to produce foam by virtue of the mixing of certain chemicals.

DETAILED DESCRIPTION OF THE DRAWINGS

DETAILED DESCRIPTION OF THE PREFERRED EMBODIMENT

Figure 1:
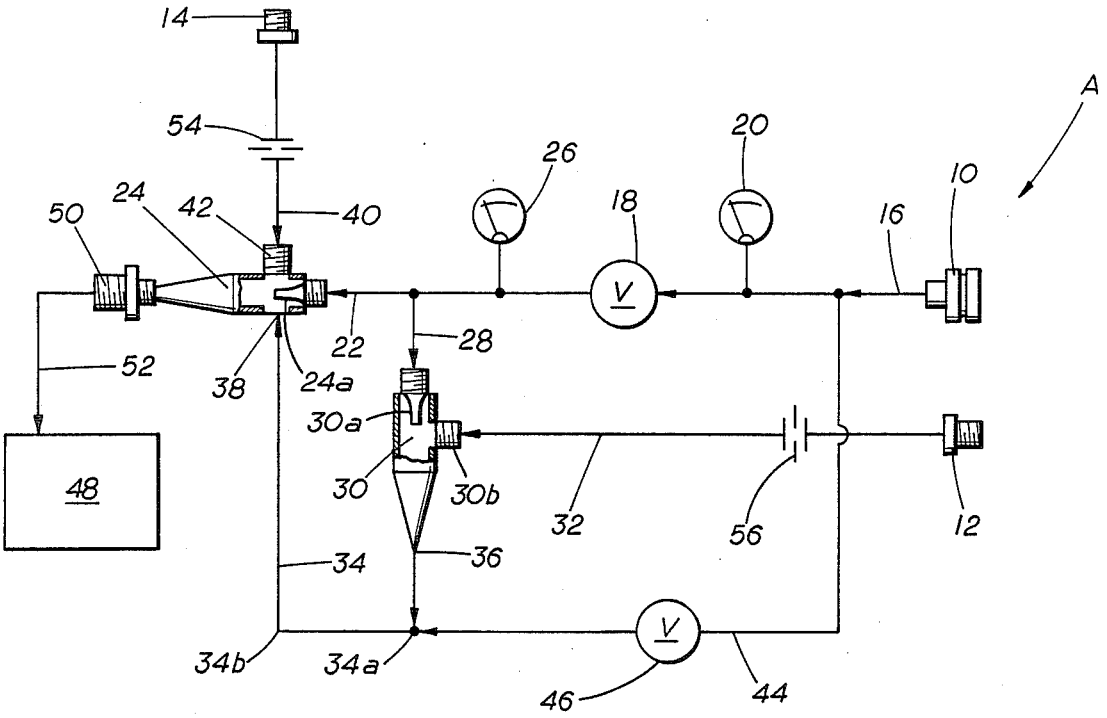
FIG. 1 is a schematic representation of one embodiment of the apparatus of the present invention.

The apparatus A of the present invention has a motive fluid inlet 10, a first chemical inlet 12 and a second chemical inlet 14. It is understood that more than two inlets may an be provided; however, two chemical inlets are present in the preferred embodiment. A conduit 16 connects motive fluid inlet 10 to a valve 18. A pressure gauge 20 is disposed in conduit 16. A conduit 22 extends from valve 18 to eductor means 24.

A pressure gauge 26 is disposed in conduit 22. A conduit 28 extends from conduit 22 to an ejector means 30. A conduit 32 extends from the first chemical inlet 12 to the ejector means 30. A conduit 34 extends from the outlet 36 of ejector means 30 to a chemical inlet port 38 on eductor means 24. A conduit 40 extends from the chemical inlet 14 to a chemical inlet 42 on the eductor 24. The eductor 24 is of conventional construction and includes a typical venturi 24*a* adjacent the inlets 38 and 42, with a resultant feed and mixing of the chemicals and water or other motive liquid in the eductor before discharge therefrom into line 52.

A conduit 44 extends from conduit 16 to conduit 34. A valve 46 is disposed in conduit 44. A foam nozzle 48 such as disclosed in U.S. Pat. No. 4,640,461 can be employed when mixing proper chemicals to create a stabilized foam. Nozzle 48 is connected to the outlet of eductor means 24 either directly or via conduit 52. A restriction orifice 54 can be employed in conduit 40 to regulate the rate of flow of the second chemical into the eductor 24. Similarly, a restriction orifice 56 can be employed in conduit 32 to regulate the rate of flow of the first chemical into the ejector 30, which as will be explained, controls the rate of flow of the first chemical into the eductor 24.

The ejector 30 is also of conventional construction with a typical venturi 30*a* adjacent inlet 30*b* from line 32. It has been found that the ejector 30 must be positioned vertically while the eductor 24 may be positioned horizontally and it is believed some back pressure must be developed in line 34 to keep the venturi 30 flooded in use. The back pressure has been accomplished with the right angle turns or elbows 34*a* and 34*b* in the pipe 34, although it is believed other means may be utilized for that purpose.

When using the apparatus A of the present invention to make stabilized foam, the foam concentrate is admitted through chemical inlet 12 and the stabilizer is admitted through chemical inlet 14. The stabilizer compound which is the one preferably used (Minnesota Mining and Manufacturing Co. "FS-7000") is very sensitive to water and hardens to a stiff gel state within one and one-half minutes of contact with water. Typically, water is used as the motive fluid connected to inlet 10. Therefore, the initial exposure of the stabilizer to the water does not occur until they both enter the eductor 24.

The inlet 42 is preferably disposed opposite the inlet 38, and conduit 40 is disposed to provide gravity flow of the stabilizer into eductor 24 The distance between outlet 50 and foam nozzle 48 should be as short as possible to prevent clogging of lines by hardening of stabilizer material prior to discharge from the nozzle 48.

Valve 18 is used to throttle the incoming motive fluid stream so that gauge 26 records in the range of preferably 80 to 125 pounds per square inch. Varying nozzle designs 48 can be employed to obtain foam having expansion ratios of foam to original liquids as high as about 20 to 1 by volume or as low as about 8 1 to 1 by volume. The higher expansion ratios are desirable to economize on chemicals when covering large spills. The lower expansion ratios are more desirable for disposal applications where a great deal of foam does not necessarily have to be produced.

With the stabilizer and foam concentrate presently known, commercial examples of which are disclosed above, it is desirable to obtain a volume ratio of approximately 1 to 1 between the stabilizer and the foam concentrate entering inlets 14 and 12 respectively. Accordingly, in one embodiment, the following line sizes are employed to obtain this ratio. Conduits 16 and 22 are one inch pipe. Conduit 32 is five-eighths inch with orifice 56 having a one-quarter inch opening. Conduit 40 is a one inch line which is expanded to one and one-quarter inches at eductor 24. Orifice 54 at conduit 40 has a nine-sixteenth inch opening.

In the final foam produced, it is desirable that the foam be composed of foam concentrate and stabilizer each comprising about six percent by volume of the water, concentrate and stabilizer liquid volume entering the eductor 24. The foam concentrate percentage is not as critical as the stabilizer percentage and the foam concentrate percentage can be as low as four percent by volume. However, it is desirable not to allow the stabilizer portion to drop below five and one-half percent by volume. The stabilizer material flows more readily at temperatures in the range of about 50° F. to about 100° F. and therefore, stabilizer volumes introduced into the educator 24 can vary in the range of six to ten percent of the total liquid depending upon the temperature of the stabilizer at the time the foam is produced in the eductor 24. The motive fluid entering the eductor 24 from conduit 22 induces flow of the stabilizer into the eductor 24, so that typically the stabilizer feeds into the eductor 24 at about three gallons per minute.

Similarly, although approximately eighty-five pounds per square inch is optimum on gauge 26, the apparatus will function with pressures as low as approximately forty-five pounds per square inch on gauge 26. Typically, the water which is introduced as the motive fluid at 10 is at 100 psi and the flow rate is 50 gallons per minute.

The motive fluid entering inlet 10 provides, through conduit 28, the motive force for drawing foam concentrate through inlet 12. In the specific embodiment described above, the flow of motive fluid in line 28 is one and one-half gallons per minute so as to obtain a flow of approximately three gallons per minute of foam concentrate into and through the ejector 30.

The motive fluid passing through conduit 22 and into eductor 24 reduces the pressure in conduit 34 and induces flow of the foam concentrate into inlet 38. Thus, the motive fluid entering ejector 30 through conduit 28 plus the reduced pressure in the eductor 24 acting on conduit 34 independently provides a predetermined volume flow rate of foam concentrate which facilitates the maintaining of the desired proportion of foam concentrate to the amount of stabilizer being drawn into the apparatus A through inlet 14.

It should be understood that the eductor 24 and ejector 30 are not drawn to scale, and those skilled in the art would adjust the sizing of orifices in ejector 30 and eductor 24 to obtain the desired volume ratio of stabilizer to foam concentrate. As is well known, the "K" factor in hydraulic flow is the flow rate divided by the square root of the pressure. Thus, with a 50 gallon per minute flow rate at 100 psi, the K factor is about 5 for the flow through the eductor 24. With a flow of 1.5 gallons per minute of motive fluid at 100 psi through the ejector 30, its K factor is 0.15. The ratio mixture of the stabilizer to foam concentrate can be adjusted by raising or lowering the pressure of the motive fluid with fixed K factors for the eductor 24 and ejector 30, or by changing the K factor of either the eductor 24 or ejector 30.

When the apparatus A is no longer being operated for making foam, the chemicals are disconnected from inlets 12 and 14 and the foam nozzle 48 is removed from outlet 50. The valve 46 which was closed when making the foam is now opened to allow motive fluid to run through the apparatus. Water then runs out through inlets 12 and 14 to flush them of chemicals. Some of the water can run out through outlet 50 as well. The main concern is to remove all stabilizer from the eductor 24, line 40 and the rest of the apparatus A to prevent its subsequent hardening and plugging of the apparatus A.

It is understood that denser foams in the ratios of 8 to 1 by volume provide advantages such as being able to cling to vertical walls. Additionally, for toxic materials having fairly high vapor pressures, the denser foam acts to contain the generated vapors from the toxic materials.

Figure 2:
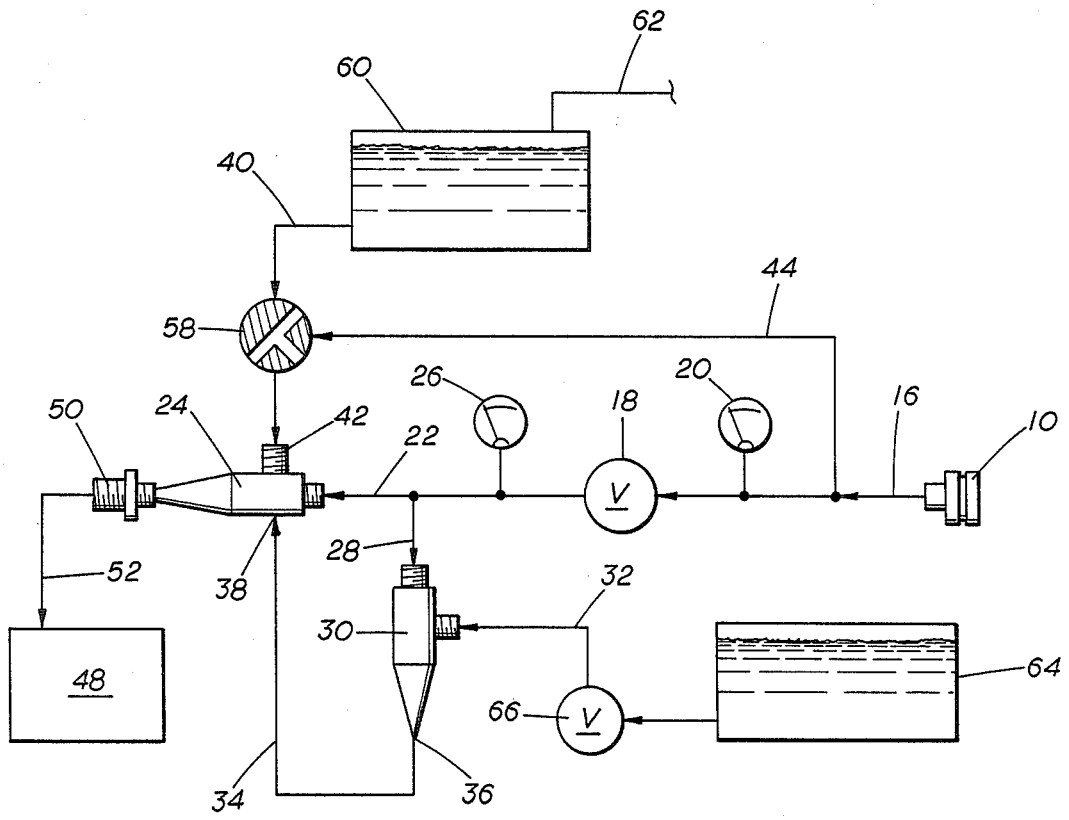
FIG. 2 is an alternative embodiment of the apparatus of the present invention depicted in schematic form.

The apparatus shown in FIG. 2 is similar to the apparatus shown in FIG. 1 except that the chemicals are supplied from tanks rather than small containers used in FIG. 1, and accordingly some differences result. The flush line conduit 44 extends between conduit 16 and conduit 40. Conduit 40 has a three way valve 58 which can be aligned to allow flow to pass from a stabilizer tank 60 into eductor 24 when making foam. Alternatively, when flushing the system, valve 58 can be aligned to permit flow from conduit 44 to inlet 42 of eductor 24. The apparatus of FIG. 2 is suitable for uses where large quantities of foam are to be produced, because the stabilizer can be stored in a large open tank with a suitable nitrogen or other inert gas blanket 62 to prevent moisture in the atmosphere from contacting the stabilizer in the tank 60. The foam concentrate may also be stored in a tank 64 with a valve 66 disposed in conduit 32. The valve 66 is open when making foam, but is closed when flushing the system. In all other respects, the construction and operation of the apparatus as shown in FIG. 2 is the same as the apparatus shown in FIG. 1 and therefore the same numerals are used in both FIGS. 1 and 2 for the same parts.

A significant advantage of the present invention as compared to the prior art is that the independent feed of the two chemicals to the eductor minimizes interaction between such flows as they enter the eductor 24, whereby the ratio of the volumes of the two chemicals to each other and to the motive fluid can be more precisely controlled as compared to feeding both chemicals directly into the eductor 24. The separate independent feed of the first chemical, the foam concentrate can thus be separately regulated from the feed of the stabilizer. Since the stabilizer viscosity varies with temperature, its feed rate changes and that can be adjusted by the size of the orifice 54. If both chemicals were fed directly into the eductor 24, it has been found that viscosity changes in the stabilizer causes fluctuations and interaction between the flows entering the eductor 24 so that the flow rate of the foam concentrate is unintentionally changed due to the stabilizer viscosity change. That problem is solved by the present invention which utilizes the independent feed of the foam concentrate with the separate ejector 30 and the gravity feed of the stabilizer chemical. Although the invention is primarily directed to the mixing of stabilizer and foam concentrate with water to make foam, it will be understood that the advantages of using a separate ejector for feeding one of the chemicals to the eductor for mixing with another chemical in the eductor in which a reduced pressure is produced by a motive fluid, may have other and different uses.

The foregoing disclosure and description of the invention are illustrative and explanatory thereof, and various changes in the size, shape and materials, as well as in the details of the illustrated construction may be made without departing from the spirit of the invention.

I claim:

1. An apparatus for mixing chemicals comprising:

a motive liquid inlet;

a first chemical inlet;

a second chemical inlet;

a mixed chemicals outlet;

an eductor means having a first chemical inlet port and a second chemical inlet port;

said eductor means having an inlet in flow communication with said motive liquid inlet for flowing liquid under pressure through said eductor means to create a reduced pressure therein, and also having an outlet in flow communication with said mixed chemicals outlet;

conduit means connecting said second chemical inlet to said second chemical inlet port of said eductor means;

ejector means disposed in fluid communication with said motive liquid inlet and also with said first chemical inlet and said first chemical inlet port of said eductor means for causing a flow of a chemical from said first chemical inlet through the ejector means to said first chemical inlet port of said eductor means substantially independently of the flow rate of a chemical flowing into said eductor means from said second chemical inlet to facilitate control of the ratio of the chemicals entering said eductor means; and said eductor means inducing flow of the chemical directly from said second chemical inlet into said second chemical inlet port and also the chemical from said ejector means for mixing the chemicals in said eductor means and discharging the mixed chemicals therefrom under pressure.

2. The apparatus of claim 1, wherein:

said first chemical inlet port and said second chemical inlet port ar aligned in opposition to each other in the vicinity of a venturi in said eductor means.

3. The apparatus of claim 1, comprising:

restriction means with said first and second chemical inlets for regulation of chemical flow through said first and second chemical inlets.

4. The apparatus of claim 1, comprising:

purge means in fluid communication with said motive liquid inlet for purging from said eductor means the chemical from said second chemical inlet.

5. The apparatus of claim 4, further comprising:

a chemical conduit between the outlet of said ejector and said first chemical inlet port on said eductor means;

said purge means further comprising a purge conduit between said motive liquid inlet and said chemical conduit; and a purge valve in said purge conduit which is normally closed but is adapted to be opened to flush chemical from said eductor means.

6. The apparatus of claim 4, wherein said purge means further comprises:

a purge conduit extending from said motive liquid inlet to said conduit means; and a multi-position valve means connected in said conduit means and said purge conduit for flow alignment of said motive liquid inlet to said conduit means in one position for flushing chemical from said eductor means and flow alignment of said second chemical inlet to said second chemical port in a second position for feeding chemical to said eductor means.

7. The apparatus of claim 6, wherein:

said multi-position valve means is a three-way valve.

8. The apparatus of claim 1, including:

an open tank connected to said second chemical inlet for holding and supplying a chemical in liquid form which hardens to a gel upon mixture with water; and means for providing an inert gas blanket on the chemical liquid in said tank to prevent contact of water therewith.

* * * * *